US007603783B2

(12) United States Patent
Lee et al.

(10) Patent No.: US 7,603,783 B2
(45) Date of Patent: Oct. 20, 2009

(54) WOODWORKING PLANE WITH ADJUSTABLE MOUTH

(75) Inventors: Robin C. Lee, Nepean (CA); Terry R. Saunders, North Gower (CA)

(73) Assignee: Lee Valley Tools, Ltd., Ottawa, ON (CA)

( * ) Notice: Subject to any disclaimer, the term of this patent is extended or adjusted under 35 U.S.C. 154(b) by 468 days.

(21) Appl. No.: 11/159,435

(22) Filed: Jun. 21, 2005

(65) Prior Publication Data

US 2005/0229409 A1 Oct. 20, 2005

Related U.S. Application Data

(63) Continuation-in-part of application No. 11/041,466, filed on Jan. 24, 2005, now abandoned, and a continuation-in-part of application No. 10/914,677, filed on Aug. 9, 2004, now Pat. No. 7,117,602.

(60) Provisional application No. 60/538,987, filed on Jan. 23, 2004.

(51) Int. Cl.
*B27G 17/02* (2006.01)

(52) U.S. Cl. ..... 30/489; 30/482; 30/491; 30/492

(58) Field of Classification Search ..... 30/487–490, 30/169, 481, 484, 491, 492; 451/482
See application file for complete search history.

(56) References Cited

U.S. PATENT DOCUMENTS

| | | | | | |
|---|---|---|---|---|---|
| 81,879 | A | | 9/1868 | Comp | |
| 99,275 | A | | 1/1870 | Tredway | |
| 186,281 | A | | 1/1877 | Traut | |
| 274,600 | A | | 3/1883 | Hegglund | |
| 306,877 | A | | 10/1884 | Traut | |
| 323,804 | A | | 8/1885 | Gage | |
| 502,906 | A | * | 8/1893 | Hardt | 30/490 |
| 545,732 | A | | 9/1895 | Schade | |
| 556,835 | A | * | 3/1896 | Smith | 30/487 |
| 636,830 | A | | 11/1899 | Miller | |
| 721,771 | A | * | 3/1903 | Allen | 30/478 |
| 749,827 | A | | 1/1904 | Sjoiander | |
| 781,771 | A | | 2/1905 | Gardner | |

(Continued)

OTHER PUBLICATIONS

"The Superior Works: Patrick's Blood and Gore Planes #71-#87," http://www.supertool.com/StanleyBG/stan10.htm, #85 Cabinet Makers Scraper Plane, Jul. 28, 2004.

(Continued)

*Primary Examiner*—Timothy V Eley
(74) *Attorney, Agent, or Firm*—Kilpatrick Stockton LLP; John S. Pratt; Camilla C. Williams

(57) ABSTRACT

A plane such as a low angle jack plane having an adjustable toe that cannot inadvertently slide backwards in the plane body so that it contacts and possibly damages the plane blade. A threaded stop mounted in the plane body bears against the toe establishing the point to which the toe can slide back in the plane body. Rotation of the threaded stop moves the end of the stop by small, easily controlled increments, making it easy to change the width of the mouth while preventing contact between the toe and the plane blade.

13 Claims, 3 Drawing Sheets

U.S. PATENT DOCUMENTS

| | | | | | |
|---|---|---|---|---|---|
| 917,915 | A | * | 4/1909 | Vander Toorn | 30/478 |
| 984,083 | A | * | 2/1911 | Faber | 30/478 |
| 1,090,225 | A | | 3/1914 | Page | |
| 1,221,436 | A | | 4/1917 | Gaede | |
| 1,417,857 | A | | 5/1922 | Pfeiffer | |
| 1,439,207 | A | | 12/1922 | Vaughan | |
| 1,440,649 | A | | 1/1923 | Tvedt | |
| 1,448,775 | A | | 3/1923 | Trump | |
| 1,567,342 | A | * | 12/1925 | Szako | 30/486 |
| 1,645,781 | A | * | 10/1927 | Szako | 30/489 |
| 1,722,742 | A | * | 7/1929 | Gloshen | 30/490 |
| 2,371,946 | A | * | 3/1945 | Benn | 30/490 |
| 2,550,766 | A | | 5/1951 | Bryant | |
| 3,028,892 | A | | 4/1962 | Filia | |
| 4,555,850 | A | * | 12/1985 | Frech | 30/490 |
| 4,584,772 | A | * | 4/1986 | Bergler | 30/475 |
| 4,589,209 | A | * | 5/1986 | Zarges et al. | 30/478 |
| 5,694,696 | A | * | 12/1997 | Lee et al. | 30/488 |
| 6,615,497 | B1 | | 9/2003 | Saunders et al. | |
| 6,708,412 | B2 | * | 3/2004 | Saunders et al. | 30/481 |
| 2003/0037446 | A1 | | 2/2003 | Saunders et al. | |
| 2005/0188553 | A1 | | 9/2005 | Lee et al. | |

OTHER PUBLICATIONS

"Rabbet planes and chisel planes," Dieter Schmid-Fine Tools, www.fine-tools.com, Jul. 3, 2004.

"Rabbet Planes," Woodcraft Supply Corporation, www.shop.woodcraft.com, printed Jul. 19, 2004.

"Stanley Rabbet Planes," Woodcraft Supply Corporation, www.shop.woodcraft.com, printed Jul. 19, 2004.

Rear Cover of Lee Valley & Veritas® Catalog, Copyright 1999.

Various Views of Extra Special Bench Plane, admitted to be prior art, 5 pages.

1998/1999 Issue of Lee Valley & Veritase® Catalog, Copyright 1998, p. 26. items H, J, K, and L; p. 27, items C & H.

Lee, Leonard, The Complete Guide to Sharpening, A Fine Woodworking Book, pp. 229-233.

Lie-Nielsen Toolworks USA, Bench Rabbet Plane, Apr. 10, 2006, pp. 1-3, http://www.lienielsen.com/catalog.php?grp=1219.

The Superior Works: Patrick's Blood and Gore Planes#9-#11-1/2, #9 Cabinetmaker's block plane, May 22, 2007, pp. 1-2, http://www.supertools.com/StanleyBG/stan2.htm.

The Superior Works: Patrick's Blood and Gore Planes #60-#70, #62 Low Angle Block plane, May 22, 2007, p. 3, http:// www.supertool.com/StanleyBG/stan9.htm.

The Superior Works: Patrick's Blood and Gore Planes #141-#196, #164 Low angle plane, May 22, 2007, p. 4, http://www. supertool.com/StanleyBG/stan13.htm.

OnlineToolReviews.com—Lee Valley/Veritas Low Angle Smoothing Plane—Detailed Review, The Stanley #164, May 22, 2007, p. 2, http://www.onlinetoolreviews.com/reviews/veritaslowanglesmoother.htm.

Record No. 073, Jan. 23, 2005, http://www.hansbrunnertools.gil.com.au/imagesMetalPlanes/Record073.JPG.

Record No. 073, Jan. 23, 2005, http://www.theoldtoolshop.fsnet.co.uk/mainpics/SR053.jpg.

Record No. 073, Jan. 23, 2005, http://home.pacbell.net/dprice1/plane5.jpg.

Record # 073 Rabbet Plane NR, Jan. 23, 2005, p. 4, http://cgi.ebay.com/ws/eBayISAPI.dll? ViewItem&item=6148715131&category=13874.

* cited by examiner

WOODWORKING PLANE WITH ADJUSTABLE MOUTH

RELATED APPLICATION DATA

This application claims priority to provisional application No. 60/538,987 filed Jan. 23, 2004 and is a continuation-in-part of application Ser. No. 10/914,677, filed Aug. 9, 2004, now U.S. Pat. No. 7,117,602 and is a continuation-in-part of application Ser. No. 11/041,466, filed Jan. 24, 2005, now abandoned.

FIELD OF THE INVENTION

This invention relates to metal-body woodworking planes.

BACKGROUND OF THE INVENTION

Low angle jack planes have long been used in woodworking, and planes having adjustable mouths have also long been used. Adjustability of the mouth (through which the plane blade projects) is desirable because it usually is preferable to use as narrow a mouth as possible for the depth of cut (or thickness of shaving produced), but depth of cut must be adjustable, with the result that the thickness of the shaving produced changes. Thicker shavings require a larger mouth opening. Adjustable mouths can be provided by making the frog to which the plane blade is secured repositionable so that the blade can be differently positioned relative to the leading edge of the mouth in the plane sole. A particularly desirable structure for providing both an adjustable mouth and support for the cutter or blade is disclosed in U.S. Pat. No. 6,615,497 for a Bench Plane, which is incorporated herein by reference. However, production of a plane with an extremely low bed angle makes it difficult to use movable frog structures.

Adjustable mouths have long been achieved in low angle planes by providing an adjustable toe ahead of the plane blade. Such a toe has a bottom coplanar with the plane body sole and can slide forward and backward to make the mouth opening ahead of the blade smaller or larger. Such a toe is usually secured to the plane body by rotating the front knob on the plane around a threaded stud that projects from the toe through a hole in the plane body until the knob (acting as a "nut" on the threaded stud) contacts the plane body, thereby securing the toe to the underside of the plane body.

One drawback associated with use of an adjustable toe is that the toe can slide backward, for instance, if it strikes a protrusion from the work-piece or a benchstop, and contact and damage the cutting edge of the plane blade. It can also be difficult to adjust the position of the toe by the small increments often necessary in order to position the toe precisely where desired to achieve a particular mouth opening ahead of the plane blade.

Another difficulty associated with adjustable mouth planes is that smaller mouth openings create a greater tendency for the mouth to become clogged with shavings, which requires interruption of use of the plane in order to clear the mouth.

SUMMARY OF INVENTION

This invention is a plane having an adjustable toe that cannot inadvertently slide backwards in the plane body so that it contacts and possibly damages the plane blade. Moreover, this plane permits the mouth to be easily and quickly opened to clear shavings and then easily and quickly closed to the previously selected mouth opening size. The toe slides in the plane body forward and rearward. Rearward travel can be stopped by threaded stop screw mounted in the plane to bear against the toe, thereby establishing the point to which the toe can slide back in the plane body. Rotation of the threaded stop moves the end of the stop by small, easily controlled increments, making it easy to change and establish the width of the mouth while preventing contact between the toe and the plane blade. Because the threaded stop prevents only rearward travel beyond the position at which the toe contacts the stop, the knob securing the toe in the plane can be rotated to permit the toe to slide, and it can be easily and quickly slid forward to open the mouth and permit clearance of shavings. The toe can likewise be easily and quickly returned to precisely the same mouth opening position and the knob rotated to lock the toe in that position. This rapid operation involves grasping the handle or plane body, rotating the knob in a first rotational direction to loosen the knob until the toe can slide in the plane body, simultaneously applying force on the knob and handle or body in opposite directions away from each other until the toe slides forward in the body, thereby opening the mouth, removing the shavings from the mouth, simultaneously applying force on the knob and handle or body in opposite directions toward each other until the toe slides rearward in the body and the boss contacts the screw, and rotating the knob in the opposite rotational direction to tighten the knob.

DETAILED DESCRIPTION

Figure 1:
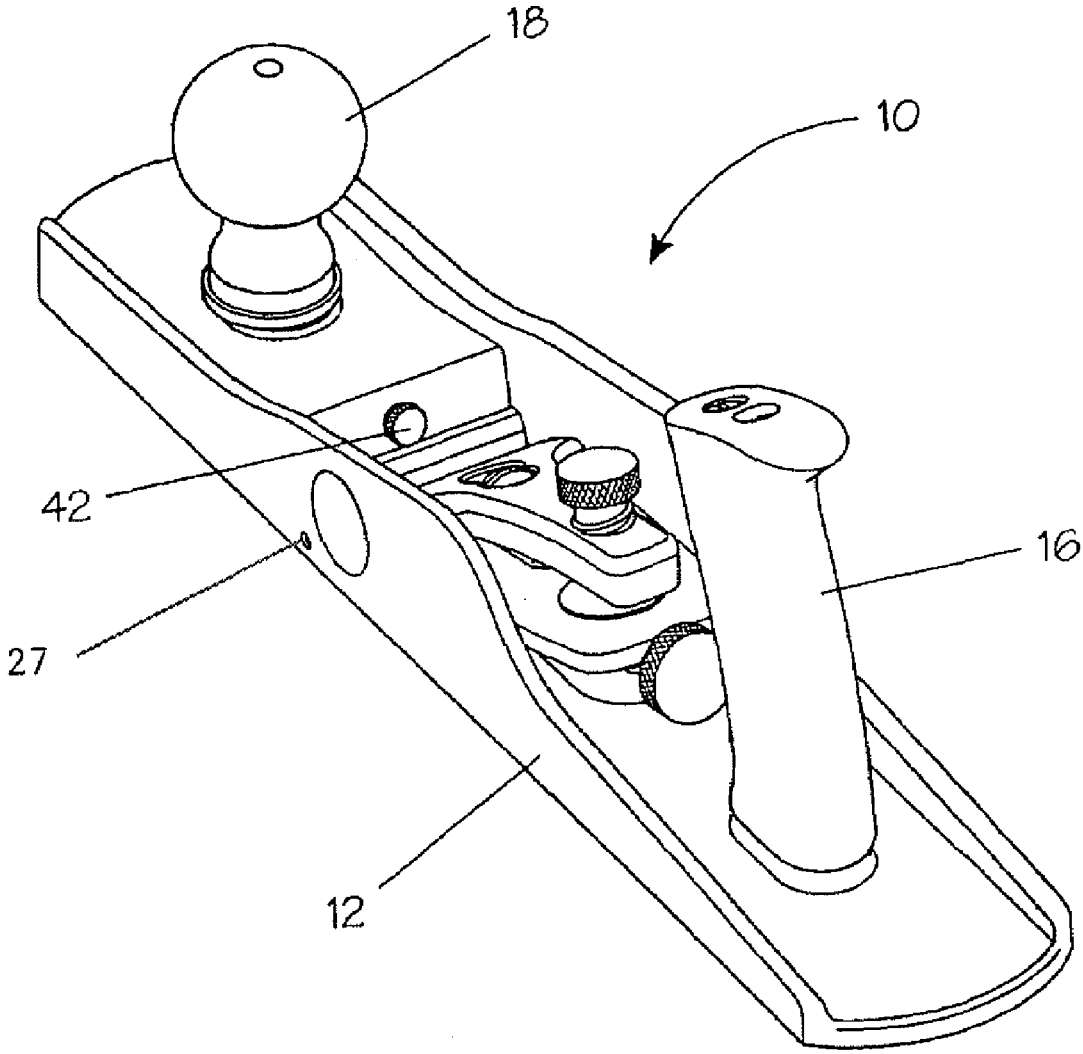
FIG. 1 is a perspective view of the top, rear and left side of the low angle jack plane of this invention.

The low angle jack plane 10 of this invention has a plane body 12 to which an adjustable toe 14 attaches on the underside at the front. Attached to the body 12 are a rear handle or tote 16, front knob 18 and a blade assembly 20 that includes a blade 22, lever cap 24 and blade adjustment mechanism 26. Plane body 12 has an integrally formed frog 50 (visible in FIGS. 2 and 3). The body 12 also includes a set screw 27 in each of the two sides of the body.

Toe 14 is secured to the plane body 12 by a threaded stud 28 that is threaded into a hole 30 in toe 14 or otherwise secured to toe 14. Stud 28 passes through oval hole 32 in body 12, washer 34, and into knob 18. Stud 28 is preferably received in a metal threaded insert 36 that has been installed in knob 18 if knob 18 is not itself metal or another material appropriately itself threaded. Rotation of knob 18 will either tighten or loosen engagement between toe 14 and plane body 12 in order to secure toe 14 in a selected position or (by loosening knob 18) permit toe 14 to be moved within body 12.

Figure 2:
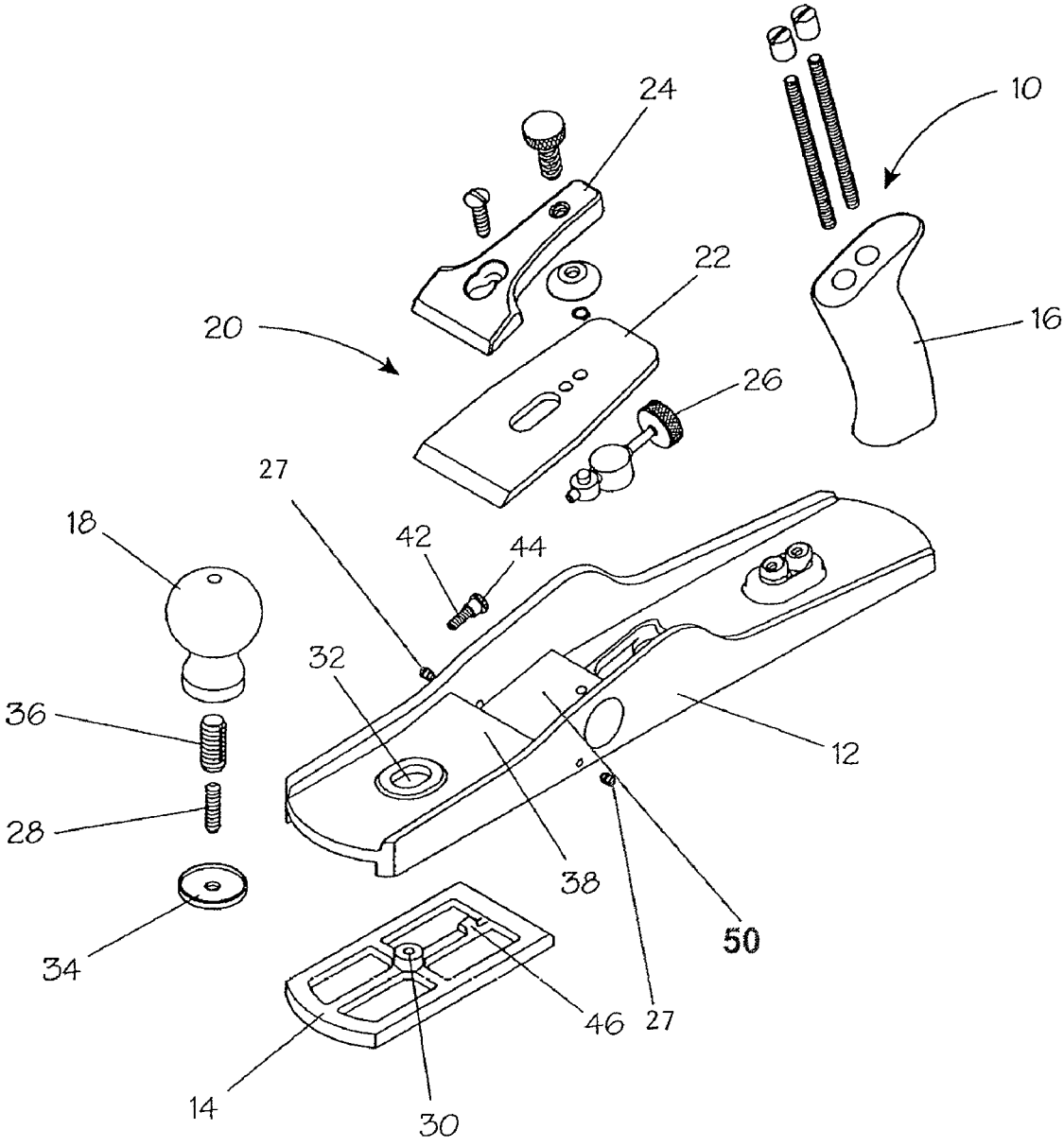
FIG. 2 is an exploded perspective view of the top, left side and front of the low angle jack plane shown in FIG. 1.
Figure 3:
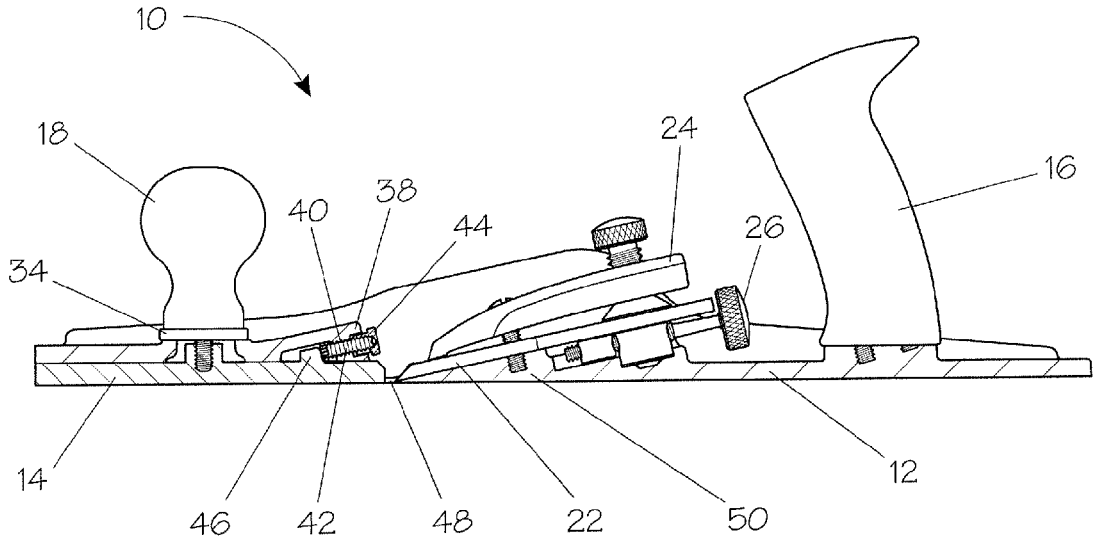
FIG. 3 is a left side view, in section through the plane body and toe, of the low angle jack plane shown in FIG. 1.

The region 38 of body 12 behind hole 32 is somewhat thickened, as can be seen in FIGS. 2 and 3, so that a threaded hole 40 can be formed in that portion of body 12 generally aligned with the longer dimension of the plane 10 and, preferably, at a small angle relative to the sole, as can be well seen in FIG. 3. A screw or threaded stud 42 is positioned in hole 40 to serve as a stop. Stud 42 can have a knurled head 44 on one end as shown in the figures (or a slotted, square recess, Phillips, Allen or other head if desired). A knurled head 44 or other appropriately shaped head on stud 42 can be hand rotated (i.e., without a tool by a user's fingers), and a head 44 having a slot, square recess, Philips, Allen or other similar head will be more easily rotated with an appropriate driver.

Hole 40 can be stepped if desired to permit a portion of the head 44 to be received in a larger diameter portion of hole 40. The other end of stud 42 bears against a rear-facing face of a protrusion or boss 46 formed on the upper side of toe 14, thereby limiting travel of the toe 14 rearward or into plane body 12. As will be readily appreciated by reference to FIG. 3, rotating stud 42 into plane body 12 forces toe 14 to move forward, thereby opening mouth 48 wider, and rotating stud 42 out of the plane body 12 permits toe 14 to move backwards, thereby closing mouth 48. Significantly, once toe 14 contacts the end of stud 42, toe 14 cannot slide any further back and therefore cannot make mouth 48 narrower or contact blade 22.

Also significantly, the mouth 48 can be quickly opened to facilitate removing shavings lodged in the mouth during use and then quickly closed to its previous size by rotating knob 18 enough to loosen the toe 14, pushing knob 18 and toe 14 forward to open the mouth 48, and then sliding knob 18 and toe 14 backward until toe 14 encounters the end of stop screw 42.

The adjustable toe of this invention facilitates accessibility and easy adjustment of the mouth opening. The toe 14 may be easily adjusted by positioning the plane vertically with the toe 14 pointing up and with the knob 18 loose. The toe 14 is then free to slide toward and rest against the stud 42. The stud 42 may then be rotated to raise or lower the toe 14 while sighting through the mouth. This method of adjusting the mouth opening allows adjustment of the width of the mouth in small increments. This method of adjustment also reduces the number of test passes the user has to make to determine if the desired mouth opening width has been achieved.

As will be appreciated by those skilled in the art, the exact structure described above and shown in the figures is not necessary to practice this invention. The benefits of mouth adjustability and blade damage prevention of this invention can be achieved with other structures. For instance, a stud, screw or other similar fitting can be positioned in the toe 14 for contact with a portion of the plane body 12. Additionally, the body region 38 through which stud 42 is threaded could be shaped differently, as could the protrusion or boss 46. Indeed, stud 42 could contact a recess or other structure on toe 14 rather than a protruding boss 46. In another variation, a position adjusting screw could be threaded into toe 14 and positioned to contact structure on the plane body 12. Structures other than threaded stud 42 could also be used, such as a movable wedge, but threaded members do provide highly functional adjustability in small increments.

The toe travel limiting and position adjusting structures of this invention could also be utilized in a variety of planes having moveable toes other than low angle jack planes, including bench planes of various sizes and configurations and block planes.

Accordingly, as will be understood by those skilled in the art, numerous configurations of the toe stop and adjustment mechanisms of this invention can be practiced within the scope and spirit of this invention and the following claims in addition to the embodiments described above and illustrated in the drawings.

The invention claimed is:

1. A woodworking plane comprising:

(a) a metal plane body having (i) a throat and (ii) a mouth through which a blade may project, (b) a movable toe secured in the body to move forward to enlarge the mouth or rearward to make the mouth smaller, and (c) an adjustable stop positioned in the body to adjustably limit rearward movement of the toe without limiting forward movement of the toe, the stop comprising a threaded shaft positioned in a threaded hole in the body.

2. The plane of claim 1, wherein the stop comprises a knurled head located in the throat of the body.

3. The plane of claim 1, wherein an end of the stop is adapted to bear against the toe and limit the travel of the toe in the plane body.

4. The plane of claim 3, wherein the toe further comprises a protrusion adapted to bear against the stop.

5. The plane of claim 1, further comprising a knob attached to the body, wherein rotation of the knob will either tighten or loosen engagement between the toe and the body.

6. The plane of claim 5, further comprising a stud, wherein the stud is positioned in the knob and passes through the body and into the toe.

7. The plane of claim 1, further comprising set screws on either side of the body and adapted to prevent a blade from shifting during use while allowing full lateral adjustment.

8. A woodworking plane comprising:

(a) a plane body having an integrally formed frog on which to bed a plane blade, (b) a movable toe positioned in the body to move forward or rearward in the body, and (c) an adjustable stop positioned in the body to adjustably limit rearward travel of the toe in the body, wherein the body has two sides and further comprises a set screw in each of the two sides of the body adapted to prevent a blade from shifting during use while allowing full lateral adjustment of the blade.

9. A woodworking plane comprising:

(a) a metal plane body having an integrally-formed frog on which to bed a blade and a mouth through which the blade may project, (b) a movable toe secured in the body to move forward to enlarge the mouth or rearward to make the mouth smaller, (c) a hand rotatable, threaded stop screw positioned in the body to adjustably limit rearward movement of the toe, (d) a threaded stud secured to the toe and positioned to project through a hole in the body and receive a knob that may be tightened on the stud to secure the toe in a desired position or loosened on the stud to permit the toe to slide in the body.

10. A method for rapidly clearing shavings from the mouth of a woodworking plane having a metal plane body on which a blade is bedded, a mouth through which the blade projects and a handle attached to the body, a movable toe secured in the body to move forward to enlarge the mouth or rearward to make the mouth smaller, a threaded stop screw positioned in the body to adjustably limit rearward movement of the toe by contact with a boss on the toe, a threaded stud attached to the toe and positioned to project through a hole in the body and a knob that may be rotated to secure the toe in a desired position or to loosen the toe to permit the toe to slide in the body, the method, comprising:

(a) grasping the handle or body, (b) rotating the knob in a first rotational direction to loosen the knob until the toe can slide in the plane body, (c) simultaneously applying force on the knob and the handle or body in opposite directions away from each other until the toe slides forward in the body, thereby opening the mouth, (d) removing the shavings from the mouth, (e) simultaneously applying force on the knob and the handle or body in opposite directions toward each other until the toe slides rearward in the body and the boss contacts the screw, and (f) rotating the knob in the opposite rotational direction to tighten the knob.

11. A method for easily adjusting the mouth opening of a woodworking plane having a metal plane body on which a blade is bedded, a mouth through which the blade projects and a handle attached to the body, a movable toe secured in the body to move forward to enlarge the mouth or rearward to make the mouth smaller, a threaded stop screw positioned in the body to adjustably limit rearward movement of the toe by contact with a boss on the toe, a threaded stud secured to the toe and positioned to project through a hole in the body and a knob that may be tightened to secure the toe in a desired position or loosened on the stud to permit the toe to slide in the body, the method, comprising:

(a) rotating the knob in a first rotational direction to loosen the knob until the toe can slide in the plane body and positioning the plane vertically with the toe pointing up, (b) allowing the toe to slide in the body until the boss contacts the screw, (c) rotating the screw to raise or lower the toe while sighting through the mouth.

12. A woodworking plane comprising:

(a) a plane body having an integrally formed frog on which to bed a plane blade, (b) a movable toe positioned in the body to move forward or rearward in the body, and (c) an adjustable stop positioned in the body to adjustably limit rearward travel of the toe in the body, wherein the stop comprises a threaded shaft positioned in a threaded hole in the body.

13. A woodworking plane comprising:

(a) a metal plane body having an integrally-formed frog on which to bed a blade and a mouth through which the blade may project, (b) a movable toe secured in the body to move forward to enlarge the mouth or rearward to make the mouth smaller, (c) a hand rotatable, threaded stop screw positioned in the body to adjustably limit rearward movement of the toe, (d) a threaded stud secured to the toe and positioned to project through a hole in the body and receive a knob that may be tightened on the stud to secure the toe in a desired position or loosened on the stud to permit the toe to slide in the body.

* * * * *